US010035681B2

(12) United States Patent
Turek

(10) Patent No.: US 10,035,681 B2
(45) Date of Patent: Jul. 31, 2018

(54) BELT-DRIVEN PEOPLE CONVEYOR

(71) Applicant: Otis Elevator Company, Farmington, CT (US)

(72) Inventor: Alexander Turek, Vienna (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/622,130

(22) Filed: Jun. 14, 2017

(65) Prior Publication Data

US 2017/0362060 A1 Dec. 21, 2017

(30) Foreign Application Priority Data

Jun. 15, 2016 (EP) ..... 16174584

(51) Int. Cl.

| | |
|---|---|
| ***B66B 21/00*** | (2006.01) |
| ***B66B 7/06*** | (2006.01) |
| ***B66B 23/02*** | (2006.01) |
| *B66B 21/10* | (2006.01) |

(52) U.S. Cl.

CPC ..... *B66B 7/062* (2013.01); *B66B 23/024* (2013.01); *B66B 23/026* (2013.01); *B66B 21/10* (2013.01); *B66B 23/028* (2013.01)

(58) Field of Classification Search

CPC ..... B66B 23/10; B66B 23/00; B66B 21/10; B66B 23/028

USPC ..... 198/321, 326, 465.2, 580

See application file for complete search history.

(56) References Cited

U.S. PATENT DOCUMENTS

| | | | | |
|---|---|---|---|---|
| 4,397,096 | A | 8/1983 | Kraft et al. | |
| 4,648,856 | A | 3/1987 | Matsunaga | |
| 5,785,166 | A | 7/1998 | Hoefling et al. | |
| 6,348,025 | B1 | 2/2002 | Schoenenberger | |
| 6,607,064 | B2 | 8/2003 | Inoue | |
| 7,063,202 | B2 * | 6/2006 | Ossendorf | B66B 21/10 198/321 |
| 7,353,932 | B2 | 4/2008 | Aulanko et al. | |
| 7,410,043 | B2 | 8/2008 | Aulanko et al. | |
| 7,424,944 | B2 | 9/2008 | Mustalahti et al. | |
| 7,484,614 | B2 * | 2/2009 | Aulanko | B66B 23/10 198/321 |

(Continued)

FOREIGN PATENT DOCUMENTS

| | | |
|---|---|---|
| CN | 103130083 A | 6/2013 |
| CN | 105438949 A | 3/2016 |

(Continued)

OTHER PUBLICATIONS

Alter, Lloyd, "The ACCEL moving sidewalk from ThyssenKrupp is a dream come true", TreeHugger.com, Nov. 9, 2015, 7pgs.

(Continued)

*Primary Examiner* — James R Bidwell

(74) *Attorney, Agent, or Firm* — Cantor Colburn LLP

(57) ABSTRACT

A people conveyor (2) comprises at least one belt (4) extending in a longitudinal conveying direction, a plurality of webs (6) attached to the belt (4), and a plurality of transportation elements (14). Each of the transportation elements (14) comprises at least one connection portion (20). The connection portions (20) extend laterally from the transportation elements (14) and are configured for being connected with at least one of the webs (6) for attaching the respective transportation element (14) to the belt (4).

15 Claims, 7 Drawing Sheets

(56) References Cited

U.S. PATENT DOCUMENTS

| | | | |
|---|---|---|---|
| 7,500,549 | B2 | 3/2009 | Aulanko et al. |
| 8,276,738 | B2 | 10/2012 | Gonzalez Alemany et al. |
| 8,424,667 | B2 | 4/2013 | Gonzalez Alemany et al. |
| 8,522,951 | B2 | 9/2013 | Gonzalez Alemany et al. |
| 8,607,958 | B2 | 12/2013 | Makovec et al. |
| 2005/0258016 | A1 | 11/2005 | Fargo et al. |
| 2005/0279611 | A1* | 12/2005 | Ossendorf ..... B66B 23/02 198/321 |
| 2006/0225988 | A1* | 10/2006 | Mustalahti ..... B65D 19/42 198/321 |
| 2006/0266617 | A1* | 11/2006 | Mustalahti ..... B65G 17/123 198/321 |
| 2009/0101471 | A1 | 4/2009 | Gonzalez Alemany et al. |
| 2015/0284217 | A1 | 10/2015 | Park |
| 2015/0307327 | A1 | 10/2015 | Srb-Gaffron et al. |
| 2015/0344269 | A1 | 12/2015 | Makovec et al. |

FOREIGN PATENT DOCUMENTS

| | | | |
|---|---|---|---|
| CN | 205114793 | U | 3/2016 |
| JP | 2008120513 | A | 5/2008 |
| WO | 03051757 | A1 | 6/2003 |

OTHER PUBLICATIONS

Extended European Search Report for application EP16174584.9, dated Feb. 24, 2017, 6pgs.

* cited by examiner

BELT-DRIVEN PEOPLE CONVEYOR

BACKGROUND

The invention relates to a people conveyor, in particular to a people conveyor comprising a plurality of transportation elements which are connected and driven by at least one belt.

People conveyors such as escalators or moving walkways usually comprise a plurality of transportation elements such as steps or pallets which are connected to form an endless transportation band driven by means of a step chain or a pallet chain comprising a plurality of chain links.

The step or pallet chain, which is usually made of metal, is heavy, produces considerable noise in operation and requires sufficient lubrication and regular maintenance.

Therefore, it would be beneficial to provide an improved driving system for a people conveyor, particularly a driving system which has a reduced weight, which produces less noise in operation, and/or which does not need to be lubricated and requires to be maintained less frequently.

SUMMARY

According to an exemplary embodiment of the invention, a people
conveyor comprises: at least one belt extending in a longitudinal conveying direction; a plurality of webs attached to the belt; and a plurality of transportation elements. Each of the transportation elements comprises at least one connection portion extending laterally from the respective transportation element and being configured to be connected with at least one of the webs for attaching the respective transportation element to the belt.

Such a belt, which may be made of a plastic material, e.g. polyurethane, has less weight than a metallic chain. In addition, it produces less noise in operation and requires considerably less maintenance. In consequence, the riding comfort is enhanced and the costs for operating and maintaining the people conveyor are considerably reduced.

The interaction between the connection portions and the webs constitutes a secure non-rotatable connection between the belt and the transportation elements. As a result, the transportation elements are securely guided by the belt, in particular in the turnaround portions of the people conveyor.

The fact that the connection portions extend laterally from the transportation elements allows to arrange the at least one belt laterally next to the transportation elements. This allows reducing the height of the people conveyor. As a result, the upper surfaces of the transportation elements may be arranged close to the upper surface of the floor without providing a deep pit for accommodating the lower parts of the people conveyor. A convenient people conveyor having a low height therefore may be provided with less constructional effort and at reduced costs.

BRIEF DESCRIPTION OF THE DRAWING

In the following, exemplary embodiments of the invention are described in more detail with reference to the enclosed figures.

DETAILED DESCRIPTION

Figure 1:
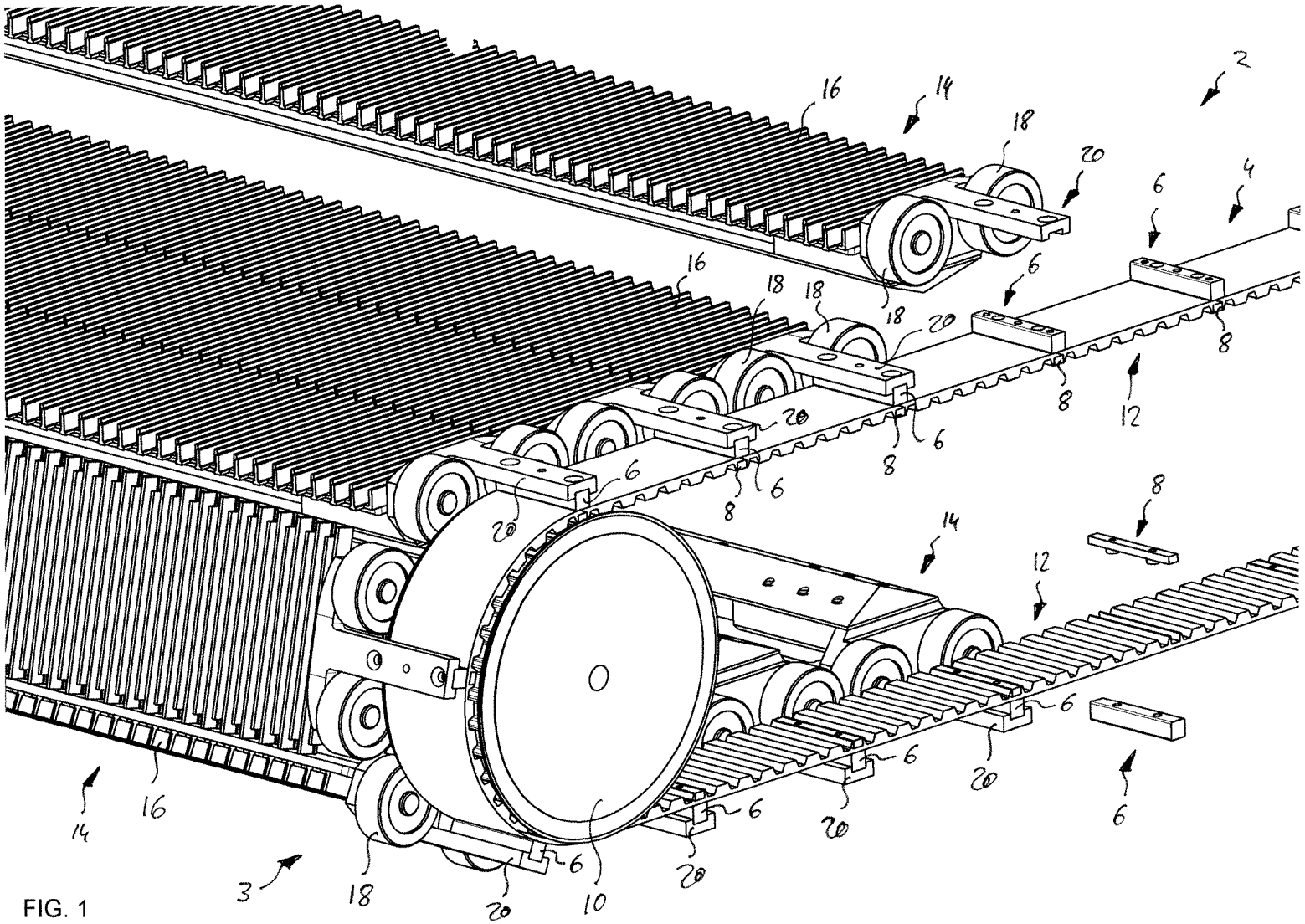
FIG. 1 shows a perspective view of a first turnaround portion of a people conveyor according to an exemplary embodiment of the invention.
Figure 2A:
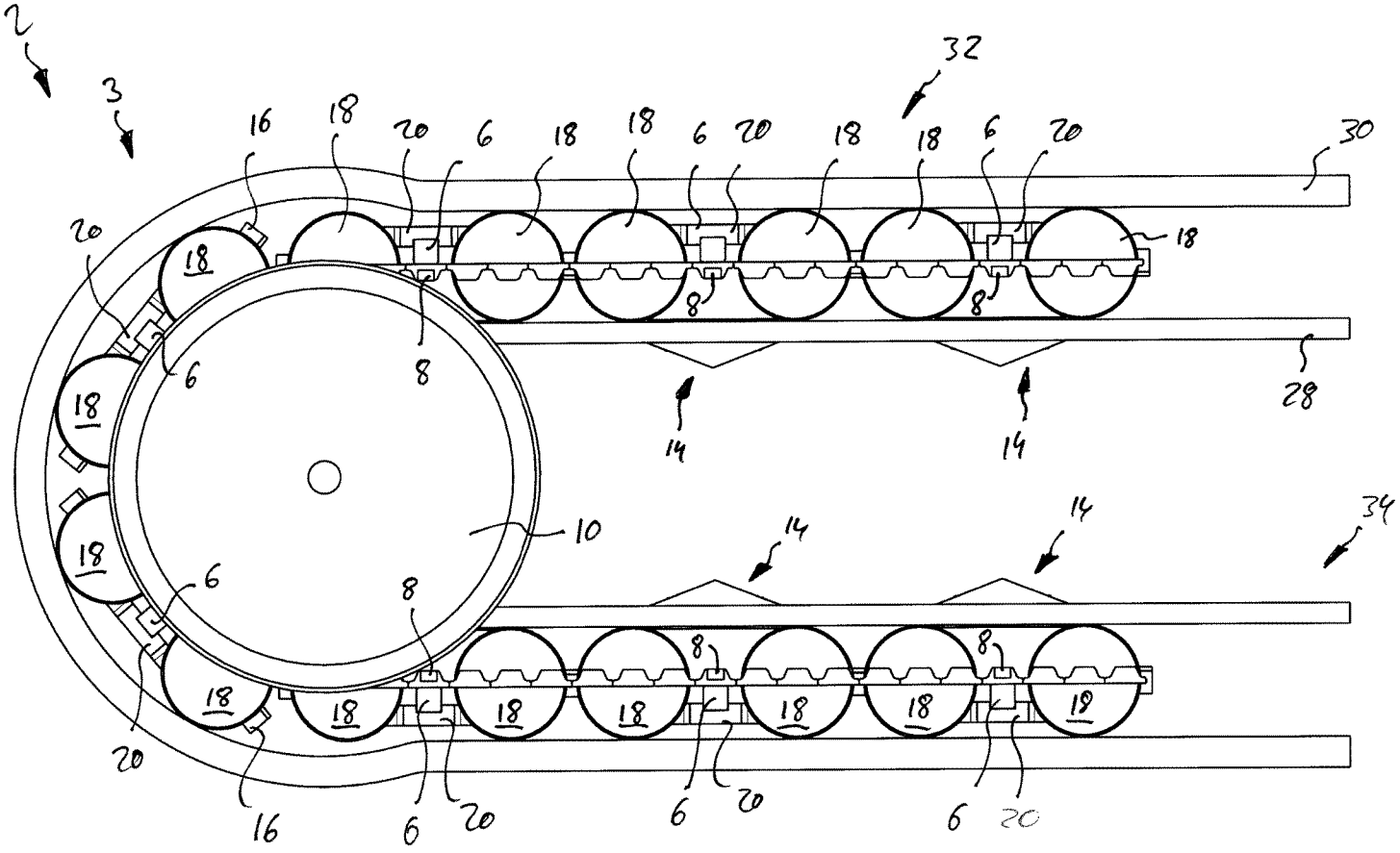
FIGS. 2*a* and 2*b* respectively show a sectional view of the first turnaround portion of a people conveyor according to an exemplary embodiment of the invention.
Figure 2B:
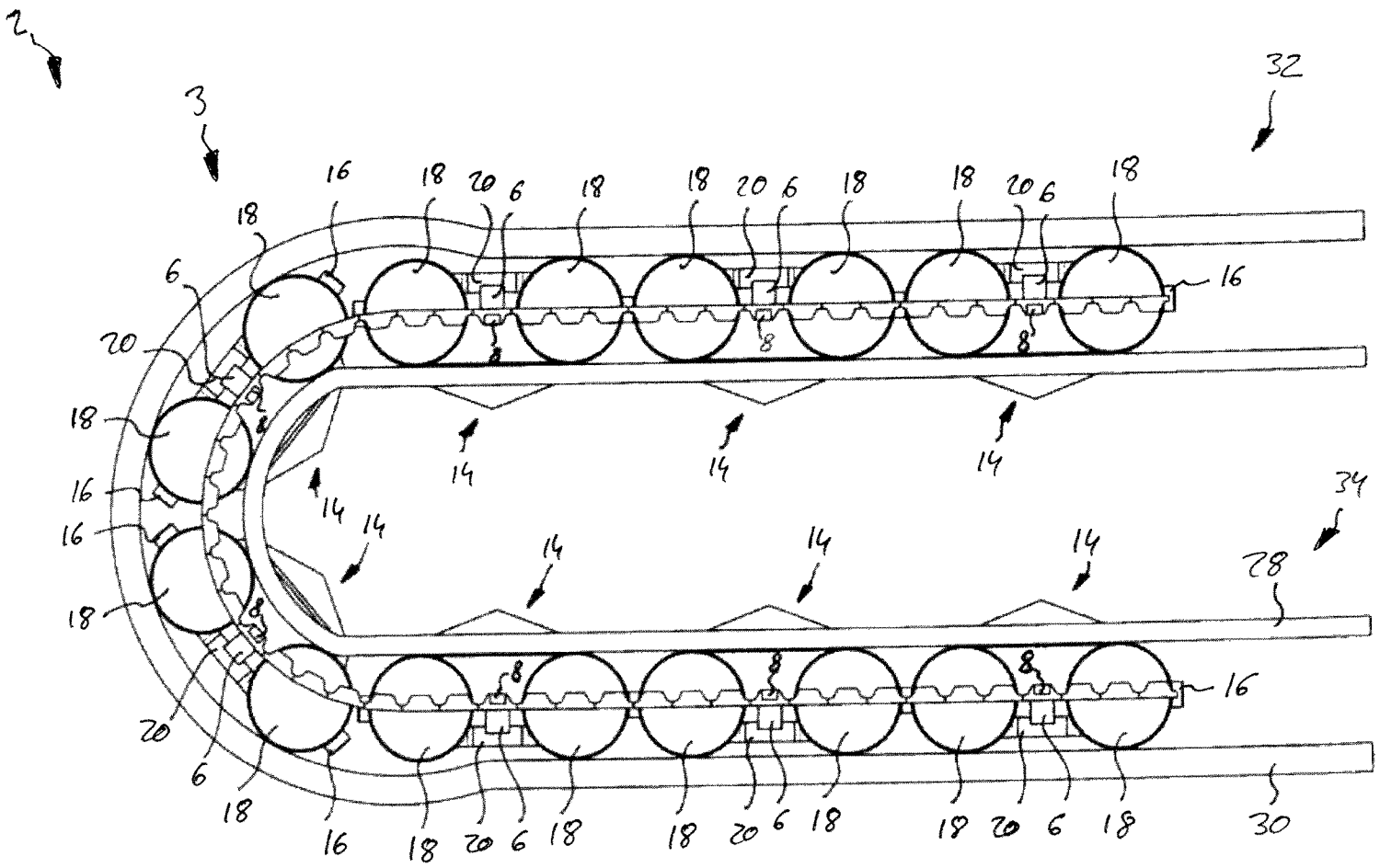

FIG. 1 shows a perspective view of a first turnaround portion 3 of a
people conveyor 2 according to an exemplary embodiment of the invention. FIGS. 2*a* and 2*b* respectively illustrate a sectional view of said first turnaround portion 3.

Figure 3:
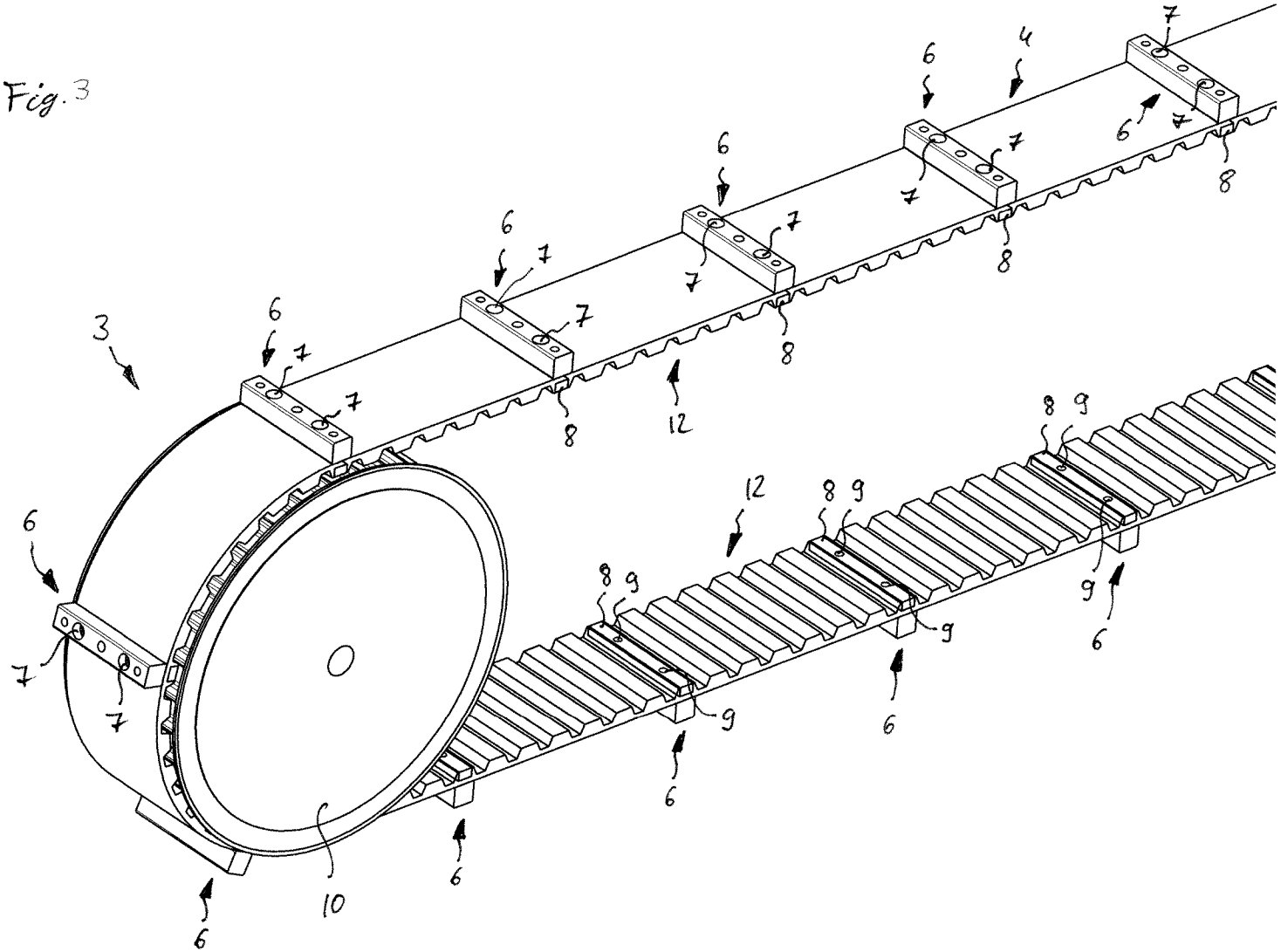
FIG. 3 shows a perspective view of a section of a belt which may be employed in a people conveyor according to an exemplary embodiment of the invention.
Figure 4:
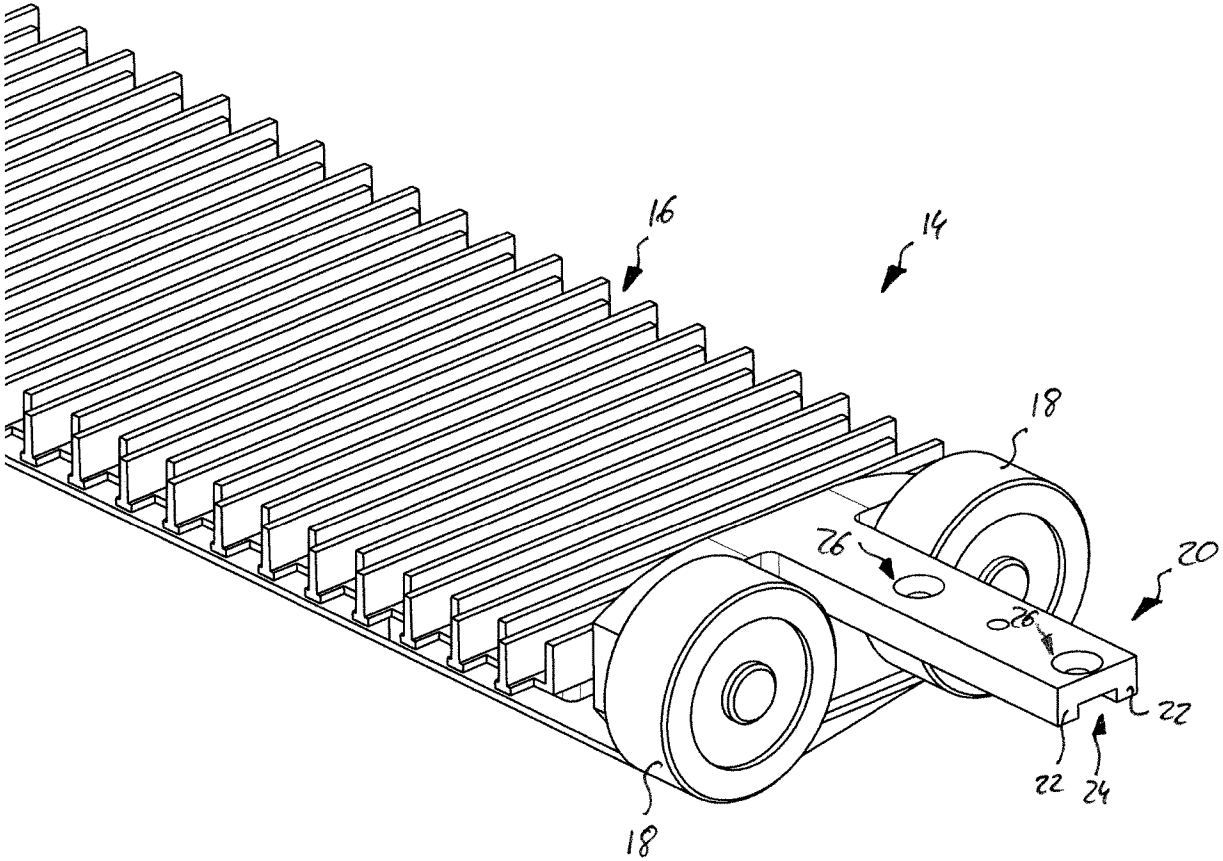
FIG. 4 shows an enlarged view of a transportation element which may be employed in a people conveyor according to an exemplary embodiment of the invention.

FIG. 3 shows a perspective view of a section of a belt 4 which may be employed in a people conveyor 2 according to an exemplary embodiment of the invention, and FIG. 4 shows an enlarged view of a transportation element 14 which may be employed in a people conveyor 2 according to an exemplary embodiment of the invention.

A people conveyor 2 according to an exemplary embodiment of the invention comprises at least one belt 4 extending along an endless loop which is oriented in a longitudinal conveying direction between two turnaround portions 3. A first turnaround portion 3 of the people conveyor 2 is shown in FIGS. 1, 2*a*, 2*b*, and 3. A second, similar turnaround portion, which is not shown in the figures, is located at an opposing end of the people conveyor 2.

Although only one belt 4 is shown in the figures, the skilled person will understand that the people conveyor 2 usually comprises at least two belts 4 extending parallel to each other on both lateral sides of the people conveyor 2. A plurality of transportation elements (pallets) 14 comprising tread plates 16, which are configured for receiving and supporting the passengers, extend between the two belts 4 in a direction which is oriented orthogonally to the conveying direction.

A toothed pulley is provided as a turnaround element 10 in the turnaround portion 3. The turnaround element 10 is not shown in FIG. 2*b* in order to allow an unobstructed view onto the turnaround portion 3. A plurality of teeth 12 are formed on the inner side of the belt 4 facing the turnaround element 10. The teeth 12 are configured for engaging with corresponding teeth formed on the outer periphery of the turnaround element (toothed pulley) 10. At least one turnaround element 10 of the people conveyor 2 is driven by a drive/motor (not shown) for driving the belt 4 and for moving the transportation elements 14 in the conveying direction.

Alternatively or additionally to driving at least one turnaround element 10, at least one linear drive (not shown) engaging with the teeth 12 of the belt 4 may be provided in one of the linear portions of the belt 4 extending between the turnaround portions 3.

A plurality of webs 6 are provided on the side of the belt 4 opposite to the teeth 12, i.e. on the side of the belt 4 forming the outer periphery of the endless loop.

The webs 6 may be fixed to the belt 4 by means of corresponding fixing elements 8 provided on the inner (teethed) side of the belt 4. The fixing elements 8 may be securely connected with a corresponding web 6 by means of screws or pins 9 (FIG. 3) extending from the respective connecting element 8 through openings 50 (see FIG. 5*a*) formed within the belt 4 into a corresponding web 6, which is positioned opposite to the respective connecting element 8. Alternatively or additionally, the webs 6 may be glued or welded to the belt 4.

In an alternative configuration, which is not shown in the figures, the webs 6 may be formed integrally with the belt 4 during the production of the belt 4.

The webs 6 are configured for being connected with corresponding connection portions 20 extending laterally from each of the transportation elements 14 of the people conveyor 2.

In the embodiment shown in FIGS. 1, 2*a*, 2*b*, and 4, the connection portions 20 have a cantilever structure extending from the lateral end of the transportation element 14 over the width of the belt 4. As a result, the belt 4 extends laterally besides the transportation elements 14 when the transportation elements 14 are connected with the belt 4 by connecting the connection portion(s) 20 of each transportation element 14 with a corresponding web 6.

The connection portions 20 and the webs 6 are respectively provided with openings 26, 7 (FIGS. 3 and 4) which are configured for receiving appropriate connection elements such as pins or screws (not shown) for securely fixing the connection portions 20 to the corresponding webs 6.

In the embodiment shown in the figures, the webs 6 are formed as rectangular bars having a rectangular or quadratic cross-section. The connection portions 20 respectively comprise a U-shaped profile including two legs 22 extending in a vertical direction and forming a rectangular recess 24 in between. Each recess 24 is open to the lower side facing the belt 4 and is configured for accommodating a corresponding web 6 via said opening. Due to the rectangular/quadratic shape of the webs 6 and the recesses 24 the transportation elements 14 are non-rotatably fixed to the belt 4. As a result, the transportation elements 14 are guided around the turnaround portion 3 by the belt 4 in combination with the turnaround element 10, as illustrated on the left side of FIGS. 1, 2*a* and 3. Thus, no additional guiding elements for guiding the transportation elements 14 need to be provided in the turnaround portion 3.

It is to be noted that the rectangular shape of the webs 6 and the corresponding recesses 24 shown in the figures is only exemplarily and the skilled person will understand that other shapes, which result in a non-rotatable connection between the transportation elements 14 and the belt 4, may be used as well.

In the embodiment shown in FIGS. 1, 2*a*, 2*b*, and 3, a web 6 is fixed to the belt 4 at the position of every seventh tooth of the belt 4. This, however, is only exemplary and the skilled person will understand that the distance of the webs 6 depends on the dimension of the transportation elements 14 in the conveying direction and that the webs 6 may be fixed to the belt 4 in any distance which is considered appropriate for the respective configuration.

In the embodiment shown in the figures the webs 6 and the connection portions 20 extend perpendicularly to the longitudinal conveying direction of the belt 4. They also extend over the whole width of the belt 4.

It is, however, possible that the webs 6 and the connection portions 20 are arranged in a slanted orientation, i.e. at an angle different from 90° with respect to the longitudinal conveying direction of the belt 4.

It is also possible that the webs 6 and the connection portions 20 do not extend over the whole width of the belt 4. A configuration in which the webs 6 and the connection portions 20 do not extend over the whole width of the belt 4 allows to provide additional guiding elements, such as pulleys, (not shown) at an outer portion of the belt 4 in some distance from the transportation elements 14 for additionally guiding the belt 4.

In the embodiment shown in FIGS. 1, 2*a*, 2*b*, and 4, two transportation elements rollers 18 are provided at each lateral end of each transportation element 14. These transportation element rollers 18 are configured for supporting the transportation elements 14 on respective guide rails/tracks 28, 30 extending parallel to the belt 4. The guide rails/tracks 28, 30 are not shown in FIG. 1 in order to allow a better view onto the transportation element rollers 18 and the connection portions 20 of the transportation elements 14.

The people conveyor 2 may comprise an inner guide rail 28 supporting the transportation element rollers 18 in an upper conveying path 32 of the people conveyor 2. The people conveyor 2 may further comprise an outer guide rail 30 supporting the transportation element rollers 18 in a lower return path 34 of the people conveyor 2.

In the configuration shown in FIGS. 1, 2*a*, 2*b*, and 4, the two transportation element rollers 18 of each transportation element 14 are arranged at the same height and in the same distance from the lateral end of the transportation element 14. In consequence, they are guided by the same guide rails 28, 30 and therefore follow the same path.

In an alternative configuration, which is not shown in the Figures, the two transportation element rollers 18 of each transportation element 14 are arranged at different heights and/or in different distances from the end of the transportation element 14. In consequence, the two transportation element rollers 18 of each transportation element 14 may be guided along different paths/guide rails (not shown), in particular in the turnaround portions 3. Guiding the transportation element rollers 18 along different paths allows to adjust the orientation/inclination of the transportation elements 14 in the turnaround portions 3. This may help to reduce the space needed for the turnaround portions.

Figure 5A:
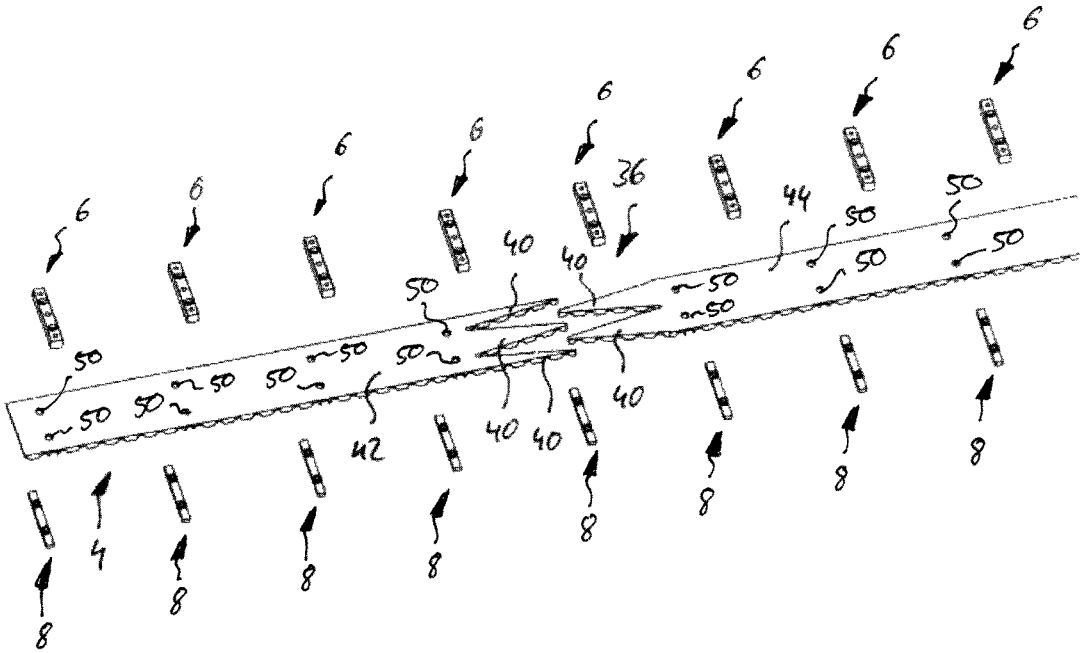
FIGS. 5*a* and 5*b* respectively illustrate a splicing for connecting two end portions of a belt for forming an endless loop.
Figure 5B:
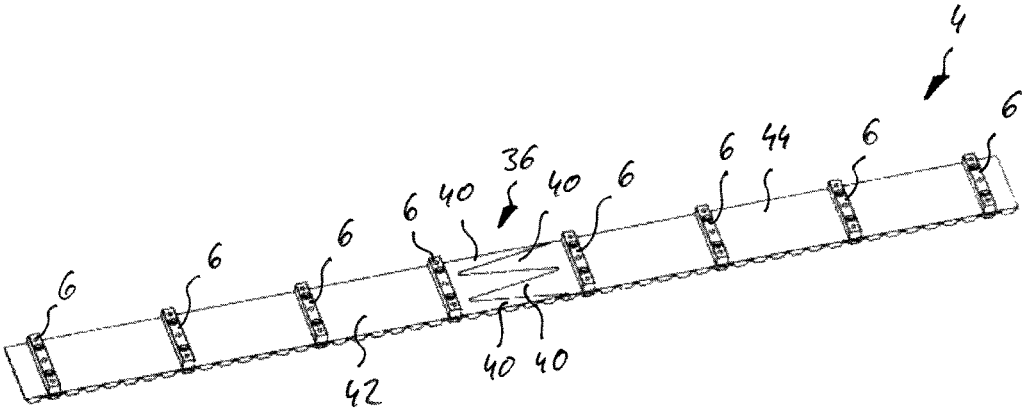

FIGS. 5*a* and 5*b* illustrates a splicing 36 connecting two end portions 42, 44 of the belt 4 for forming the endless loop. FIG. 5*a* illustrates the configuration before the two end portions 42, 44 of the belt 4 are fixed to each other, and FIG. 5*b* illustrates the configuration after the two end portions 42, 44 of the belt 4 are fixed to each other. Webs 6 are fixed to the belt 4 by means of openings 50 formed within the belt 4 and corresponding connection elements 8, as it has been described before.

Each of the end portions 42, 44 of the belt 4 is split apart into a plurality of straps 40. The straps 40 of the two end portions 42, 44 are alternately connected to each other e.g. by means of welding or by means of appropriate belt locking mechanisms (not shown) for forming the connected configuration shown in FIG. 5*b*.

Figure 6:
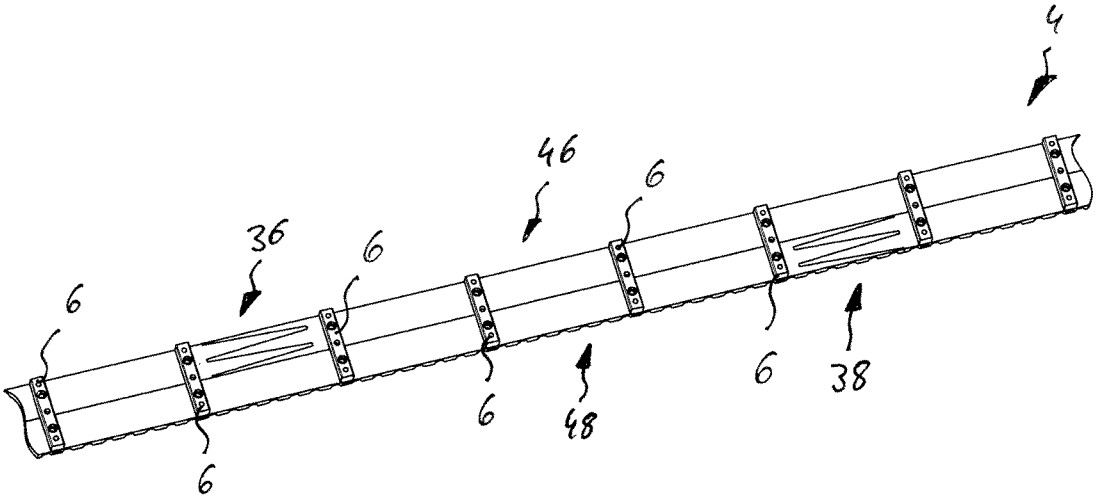
FIG. 6 shows a belt which is formed from a plurality of strands.

As shown in FIG. 6, the belt 4 may be formed from a plurality of strands 46, 48 extending parallel to each other. The splicings 36, 38 of the different strands 46, 48 in particular may be displaced with respect to each other in the longitudinal direction of the belt 4. This enhances the strength of the belt 4, as the weak portions caused by the splicings 36, 38 are distributed along the longitudinal direction and every splicing 36, 38 is supported by the non-spliced portions of the other strands.

Although the exemplary embodiment of the people conveyor 2 shown in the figures is a horizontally extending moving walkway, in which the transportation elements 14 are provided as horizontally extending pallets, the skilled person will understand that the invention may be also applied to inclined moving walkways 2 extending between two different levels of height. The invention further may be applied to escalators comprising a plurality of steps which are attached to an inclined belt extending between two different levels of height.

A number of optional features are set out in the following. These features may be realized in particular embodiments, alone or in combination with any of the other features.

In one embodiment at least some of the webs and/or of the connection portions may extend perpendicularly to the conveying direction, i.e. in the width direction of the belt. This allows for a secure and easy connection of the webs with the belt as well as an easy and secure connection between the webs and the connection portions of the transportation elements.

In one embodiment at least some of the webs and/or of the connection portions may extend over the whole width of the belt for providing a very strong connection between the webs and the belt.

In an alternative embodiment the webs and/or of the connection portions may extend only over a portion of the width of the belt, in particular only over the portion of the belt located next to the transportation elements. This allows additional driving elements and/or guiding elements to contact the belt in an area facing away from the transportation elements for driving and/or guiding the belt.

In one embodiment the webs may be arranged equidistantly along the belt in the conveying direction. This allows to fix the transportation elements equidistantly to the belt.

In one embodiment each of the connection portions may comprise a U-shaped profile which is open on the side facing the belt and which is configured for accommodating one of the webs. U-shaped profiles accommodating the webs allow to provide a mechanically strong connection between the connection portions and the webs. As a result, the transportation elements may be securely fastened to the belt.

In one embodiment each of the connection portions and the webs respectively may comprise at least one opening for accommodating a screw or bolt securing the connection portion to the web. This allows to easily secure the connection portions to the webs by means of bolts or screws extending through the openings. The openings in particular may be provided with threads which allow to securely fix the screws within the openings.

In one embodiment the connection portions and the webs may be configured such that the transportation elements, when attached to the belt, are not rotatable with respect to the belt, in particular around an axis extending orthogonally to the conveying direction. This configuration allows to guide the transportation elements along a desired path by means of the belt and therefore avoids the need for additional guiding elements, in particular in the turnaround portions of the people conveyor.

In one embodiment the webs may have a rectangular cross-section and each of the connection portions may be provided with a corresponding rectangular opening and/or recess configured for accommodating a corresponding rectangular web. Rectangularly shaped webs and corresponding openings/recesses allow to fix the transportation elements non-rotatably to the belt. The skilled person will understand that other shapes of the webs and the openings or recesses resulting in a non-rotatable connection are possible as well.

In one embodiment the webs may be formed integrally with the belt during the production of the belt. This avoids the need for an additional step of attaching the webs to the belt.

In one embodiment the webs may glued or welded to the belt and/or they may be attached to the belt by means of fixing elements such as screws and/or bolts. Attaching the webs to the belt provides additional flexibility. For example, webs made of a different material than the belt may be used, and/or the number/the distance of the webs attached to the belt may be set after the production of the belt in order to meet the needs of the respective conveyor.

In one embodiment the webs may be made of a material comprising metal and/or a plastic material which differs from the plastic material used for the belt. The belt in particular may be made of a material that is more flexible than the material used for the webs.

In one embodiment at least one transportation element roller is provided at each transportation element for supporting the transportation element on a corresponding track which is configured for supporting and/or guiding the at least one transportation element roller. Providing transportation element rollers and a corresponding track reduces the load to be carried by the belt, as a portion of the load is supported by the at least one transportation element roller in combination with the track. This allows to reduce the strength/costs of the belt and extends its lifetime.

In one embodiment at least two transportation element rollers are provided at each transportation element for supporting both lateral sides of the transportation element.

In one embodiment at least two transportation element rollers are provided on each lateral side of every transportation element. The at least two transportation element rollers in particular may be spaced apart from each other in the longitudinal direction. Such a combination of at least two transportation element rollers provided on each lateral side of every transportation element avoids an undesired tilting of the transportation elements around an axis extending perpendicularly to the conveying direction.

In one embodiment the at least two transportation element rollers may be arranged at the same height and in the same distance from the transportation element in a direction which is oriented perpendicular to the conveying direction. In such a configuration the at least two transportation element rollers may be guided along the same track. In consequence, only a single track needs to be provided for guiding a plurality of transportation element rollers.

In one alternative embodiment the at least two transportation element rollers may be arranged in different distances from the transportation element in a direction oriented perpendicular to the conveying direction and/or the at least two transportation element rollers may be arranged at different heights in a direction which is oriented orthogonally to the conveying direction. Such a configuration allows to guide the different transportation element rollers on different tracks. Guiding the transportation element rollers on different tracks allows to adjust the orientation/inclination of the transportation elements. This may be beneficial in particular in the turnaround portions of the people conveyor.

In one embodiment the belt may comprise a plurality of strands extending parallel to each other. Combining a plurality of strands allows to increase the total strength of the belt. The strength and the width of the belt may be adjusted by varying the number of strands forming the belt.

In one embodiment splicings of the different strands may be displaced with respect to each other along the conveying direction. This enhances the strength of the belt even further, as the weaknesses caused by the splicings are distributed along the longitudinal direction and every splicing is supported by the non-spliced portions of the other strands.

In one embodiment the belt may comprise a plurality of teeth which are configured for engaging with a corresponding turnaround element, e.g. a drive pulley or sprocket, which is provided for deflecting and/or driving the belt. This allows to deflect and/or drive the belt efficiently. The teeth in particular may be provided on a side of the belt which is opposite to the side of the belt on which the webs are provided in order to avoid any interference between the webs and the turnaround element.

While the invention has been described with reference to exemplary embodiments, it will be understood by those skilled in the art that various changes may be made and equivalents may be substituted for elements thereof without departing from the scope of the invention. In addition many modifications may be made to adopt a particular situation or material to the teachings of the invention without departing from the essential scope thereof. Therefore, it is intended that the invention not be limited to the particular embodiment disclosed, but that the invention include all embodiments falling within the scope of the claims.

REFERENCES

2 people conveyor
3 turnaround portion
4 belt
6 web
7 opening in the web
8 connection elements
9 screw/pin
10 turnaround element
12 teeth of the belt
14 transportation element
16 tread plate
18 transportation element roller
20 connection portion
22 leg of the connection portion
24 recess of the connection portion
26 opening in the connection portion
28 inner guide rail
30 outer guide rail
32 conveying path
34 return path
36, 38 splicings
40 straps of the belt
42, 44 end portions of the belt
46, 48 strands of the belt
50 openings in the belt

What is claimed is:

1. People conveyor comprising:

at least one belt extending in a longitudinal conveying direction;

a plurality of webs attached to the belt by fixing elements; and a plurality of transportation elements, each of the transportation elements comprising at least one connection portion;

wherein the connection portions extend laterally from the transportation elements and are configured for being connected with at least one of the webs for attaching the respective transportation element to the belt.

2. People conveyor according to claim 1, wherein at least some of the webs extend perpendicularly to the conveying direction and/or over the whole width of the belt.

3. People conveyor according to claim 1, wherein the webs are arranged equidistantly along the belt in the conveying direction.

4. People conveyor according to claim 1, wherein each of the connection portions comprises a U-shaped profile which is configured for accommodating one of the webs.

5. People conveyor according to claim 1, wherein each of the connection portions and the webs respectively comprise at least one opening for accommodating a screw or bolt.

6. People conveyor according to claim 1, wherein the connection portions and the webs are configured such that the transportation elements, when attached to the belt, are not rotatable with respect to the belt.

7. People conveyor according to any of the previous claims, wherein the webs have a rectangular cross-section.

8. People conveyor according to claim 1, wherein the fixing elements comprise at least one of screws and bolts.

9. People conveyor according to claim 1, wherein at least one transportation element roller is provided at each transportation element for supporting the transportation element.

10. People conveyor according to claim 9, wherein at least two transportation element rollers are provided at each transportation element.

11. People conveyor according to claim 10, wherein at least two transportation element rollers are provided on each lateral side of every transportation element.

12. People conveyor according to claim 11, wherein the at least two transportation element rollers are arranged at different heights and/or in different distances from the transportation element in a direction oriented perpendicular to the conveying direction.

13. People conveyor according to claim 9 further comprising at least one track which is configured for supporting and/or guiding the transportation element rollers.

14. People conveyor according to claim 1, wherein the belt comprises at least two strands extending parallel to each other, wherein in particular splicings of the different strands are displaced with respect to each other in the conveying direction.

15. People conveyor according to claim 1, wherein the belt comprises a plurality of teeth which are configured for engaging with a turnaround element.

* * * * *